US005346380A

United States Patent [19]

Ables

[11] Patent Number: 5,346,380

[45] Date of Patent: Sep. 13, 1994

[54] CAULKING TUBE EXTENSION NOZZLE

[76] Inventor: James T. Ables, 11620 Snowline Cir., Anchorage, Ak. 99516

[21] Appl. No.: 124,794

[22] Filed: Sep. 22, 1993

[51] Int. Cl.[5] ..... B05C 17/005; B28B 3/00

[52] U.S. Cl. ..... 425/87; 222/527; 222/568; 425/458; 401/266

[58] Field of Search ..... 222/527, 566–568, 222/575; 401/266, 48, 193; 425/87, 458, 12, 96

[56] References Cited

U.S. PATENT DOCUMENTS

| | | | |
|---|---|---|---|
| 721,168 | 2/1903 | Egert | 425/458 |
| 845,530 | 2/1907 | Davis | 425/458 X |
| 1,142,022 | 6/1915 | Chappell | 425/87 |
| 4,380,425 | 4/1983 | Edelman | 425/458 |
| 4,946,081 | 8/1990 | Jacobson | 222/568 |
| 5,004,128 | 4/1991 | Richichi et al. | 222/527 |
| 5,017,113 | 5/1991 | Heaton et al. | 425/87 |
| 5,020,702 | 6/1991 | James | 222/568 X |
| 5,029,738 | 7/1991 | Dillon | 222/527 |
| 5,249,716 | 10/1993 | O'Sullivan | 222/527 X |

*Primary Examiner*—Kevin P. Shaver
*Attorney, Agent, or Firm*—Gary Alan Culliss

[57] ABSTRACT

A caulking tube extension nozzle engagable to a caulking tube for facilitating a distribution of caulk onto hard-to-reach or awkwardly positioned areas. The extension nozzle includes a nozzle coupling assembly engagable to both soft plastic caulking nozzles and threaded nozzle receivers provided on caulking tubes having detachable nozzles. The coupling assembly tapers into a elongated extension tube having a flexible section which allows the extension tube to be bent while still permitting fluid communication therethrough. Alternate embodiments of the present invention include a bead forming assembly for shaping a bead of caulk dispensed from the extension nozzle and an adjustment mechanism for positioning the bead forming assembly relative to the dispensed caulk.

2 Claims, 4 Drawing Sheets

FIG 3
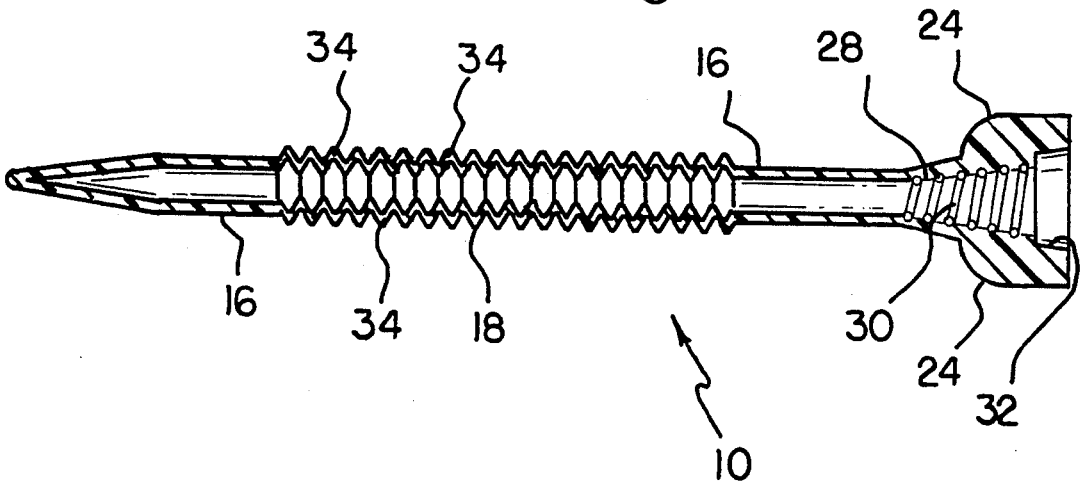
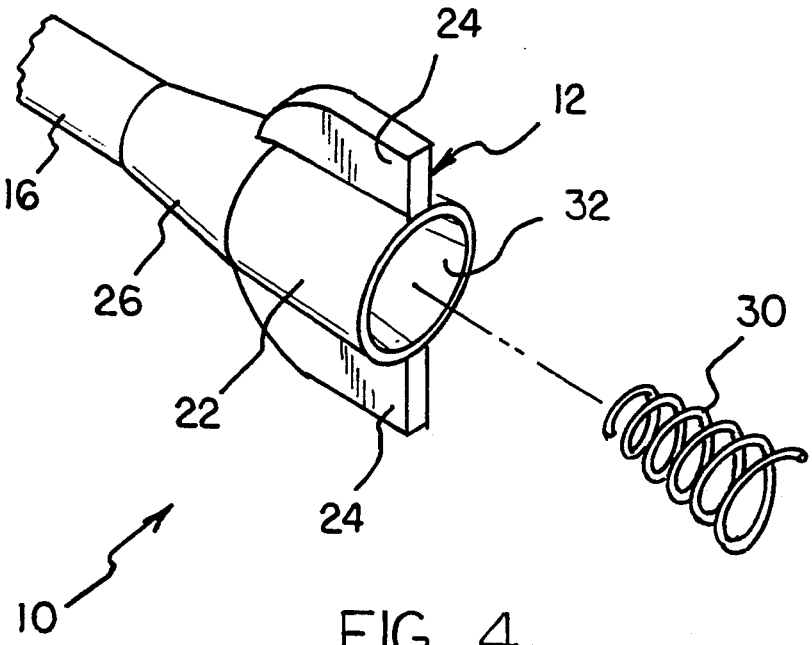
FIG 4

CAULKING TUBE EXTENSION NOZZLE

BACKGROUND OF THE INVENTION

1. Field of the Invention

The present invention relates to nozzles and more particularly pertains to a caulking tube extension nozzle engagable to a caulking tube for facilitating a distribution of caulk into hard-to-reach or awkwardly positioned areas.

2. Description of the Prior Art

The use of nozzles is known in the prior art. More specifically, nozzles heretofore devised and utilized for the purpose of dispensing caulking are known to consist basically of familiar, expected and obvious structural configurations, notwithstanding the myriad of designs encompassed by the crowded prior art which have been developed for the fulfillment of countless objectives and requirements.

For example, a replaceable caulking tip for use on caulking cartridges is illustrated in U.S. Pat. No. 4,957,225 which includes a tubular body that is internally threaded for replaceable engagement on a nozzle. An outlet orifice is formed at the other end of the body with substantial body materials surrounding the orifice to permit shaping of the tip, and reshaping if necessary. The body of the tip is preferably formed from a hard material permitting shaping of the body, yet facilitating repeated use of the tip.

A caulking nozzle is disclosed in U.S. Pat. No. 4,878,599 which comprises a series of hollow members having first and second ends wherein the first end has a first inner cross sectional dimension and the second end has a second inner cross sectional dimension such that the members may be positioned in series to form a hollow vessel having a step wise decreasing inner cross sectional first dimension, wherein the largest member comprises an opening suitable for connection to the tube and the smallest dimensioned member comprises an opening suitable for dispensing the caulk.

Another patent of interest is U.S. Pat. No. 5,104,013 which describes a caulking tube nozzle adapter adjustable for different caulk bead sizes. The adapter includes a reduced coupling having a large end secured to the caulking tube nozzle and a small end which is threaded to receive a cap to seal the caulking material within the coupling when the caulking tube is not in use. In one form, the large end of the reducing coupling is internally threaded for self-taping engagement with the caulking tube nozzle, and the small end is internally threaded for engagement with internal threads in the cap. In another form, the large end of the coupling is formed integrally with the end of the caulking tube.

Other relative documents include U.S. Pat. No. 5,154,327, and U.S. Des. No. 323,269.

While these devices fulfill their respective, particular objectives and requirements, the aforementioned patents do not disclose a caulking tube extension nozzle engagable to a caulking tube for facilitating a distribution caulk on a hard-to-reach or awkwardly positioned areas which includes an elongated extension tube having a flexible section that allows the extension tube to be bent while still permitting fluid communication therethrough. Furthermore, none of the known prior art nozzles teach or suggest both a bead forming assembly for shaping a bead of caulk dispensed from the extension nozzle and an adjustment means for positioning the bead forming assembly relative to the dispensed caulk.

In these respects, the caulking tube extension nozzle according to the present invention substantially departs from the conventional concepts and designs of the prior art, and in so doing provides an apparatus primarily developed for the purpose of facilitating a distribution of caulk onto hard-to-reach or awkwardly positioned areas.

SUMMARY OF THE INVENTION

In view of the foregoing disadvantages inherent in the known types of nozzles now present in the prior art, the present invention provides a new caulking tube extension nozzle construction wherein the same can be utilized for facilitating a distribution of caulk on hard to reach or awkwardly positioned areas. As such, the general purpose of the present invention, which will be described subsequently in greater detail, is to provide a new caulking tube extension nozzle apparatus which has many of the advantages of the nozzles mentioned heretofore and many novel features that result in a caulking tube extension nozzle which is not anticipated, rendered obvious, suggested, or even implied by any of the prior art nozzles, either alone or in any combination thereof.

To attain this, the present invention essentially comprises a caulking tube extension nozzle engagable to a caulking tube for facilitating a distribution of caulk onto hard-to-reach or awkwardly positioned areas. The extension nozzle includes a nozzle coupling assembly engagable to both soft plastic caulking nozzles and threaded nozzle receivers provided on caulking tubes having detachable nozzles. The coupling assembly tapers into a elongated extension tube having a flexible section which allows the extension tube to be bent while still permitting fluid communication therethrough. Alternate embodiments of the present invention include a bead forming assembly for shaping a bead of caulk dispensed from the extension nozzle and an adjustment means for positioning the bead forming assembly relative to the dispensed caulk.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new caulking tube extension nozzle apparatus which has many of the advantages of the nozzles mentioned heretofore and many novel features that result in a caulking tube extension nozzle which is not anticipated, rendered obvious, suggested, or even implied by any of the prior art nozzles, either alone or in any combination thereof.

It is another object of the present invention to provide a new caulking tube extension nozzle which may be easily and efficiently manufactured and marketed.

It is a further object of the present invention to provide a new caulking tube extension nozzle which is of a durable and reliable construction.

An even further object of the present invention is to provide a new caulking tube extension nozzle which is susceptible of a low cost of manufacture with regard to both materials and labor, and which accordingly is then susceptible of low prices of sale to the consulting public, thereby making such caulking tube extension nozzles economically available to the buying public.

Still yet another object of the present invention is to provide a new caulking tube extension nozzle which provides in the apparatuses and methods of the prior art some of the advantages thereof, while simultaneously overcoming some of the disadvantages normally associated therewith.

Still another object of the present invention is to provide a new caulking tube extension nozzle engagable to a caulking tube for facilitating a distribution of caulk onto hard-to-reach or awkwardly positioned areas.

Yet another object of the present invention is to provide a new caulking tube extension nozzle which includes an elongated extension tube having a flexible section which allows the extension tube to be bent while still permitting fluid communication therethrough.

Even still another object of the present invention is to provide a new caulking tube extension nozzle which includes a bead foxing assembly for shaping a bead of caulk dispensed from the extension nozzle.

Even still yet another object of the present invention is to provide a new caulking tube extension nozzle which includes an adjustment means for positioning the bead forming assembly relative to the dispensed caulk.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is an enlarged perspective view, partially exploded, of a portion of the present invention.

DESCRIPTION OF THE PREFERRED EMBODIMENTS

Figure 1:
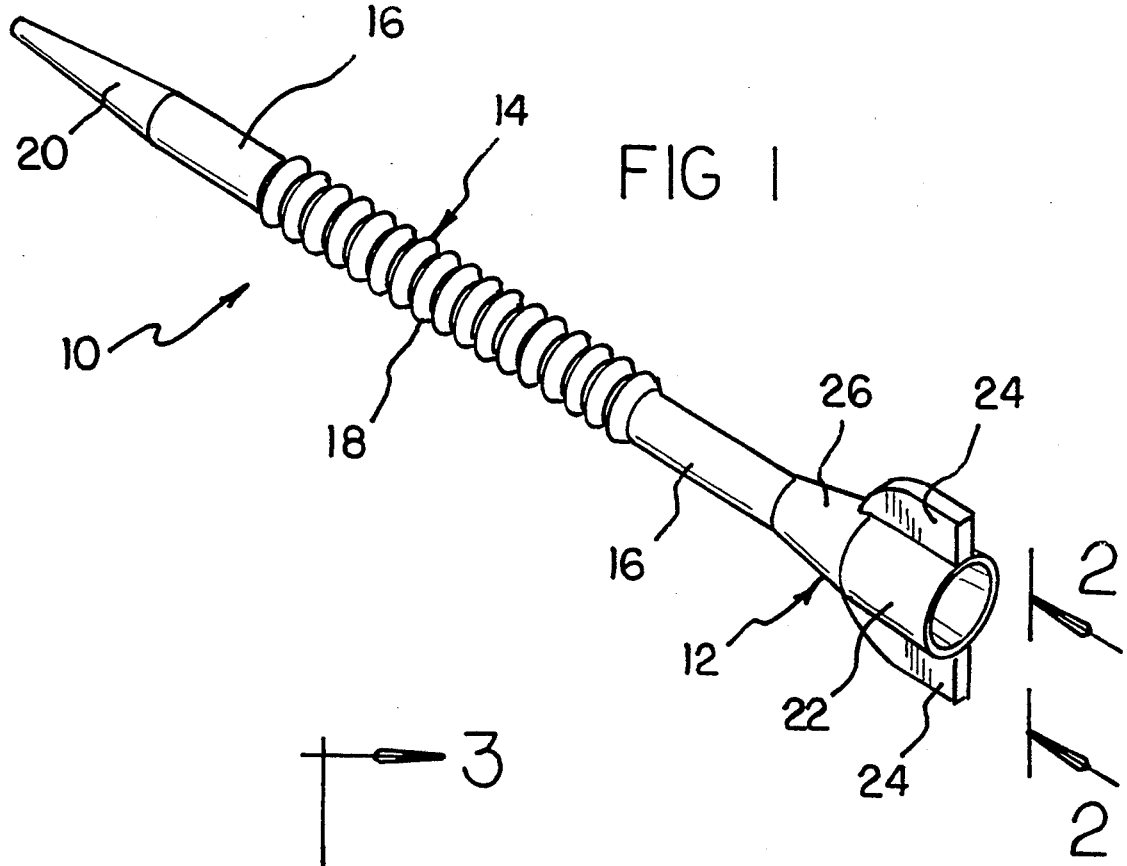
FIG. 1 is a perspective view of a caulking tube extension nozzle comprising a first embodiment of the present invention.
Figure 2:
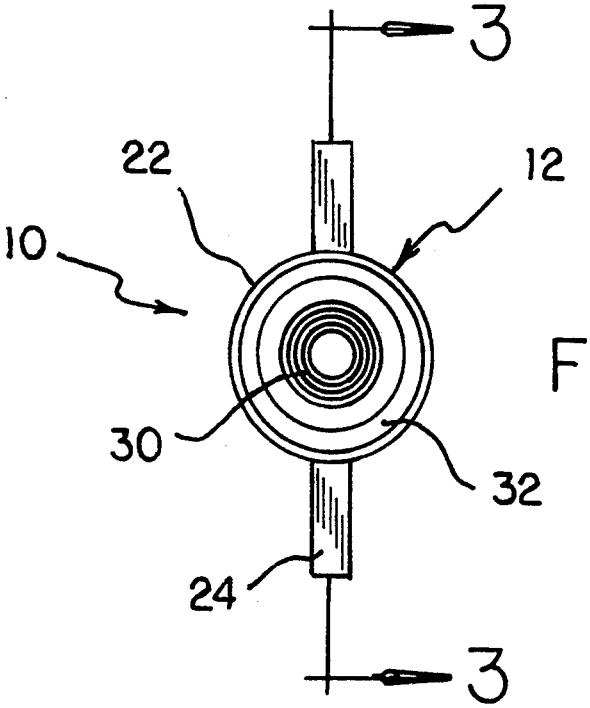
FIG. 2 is a rear elevation view of the present invention as viewed from line 2—2 of FIG. 1.

With reference now to the drawings, and in particular to FIGS. 1-4 thereof, a first embodiment of a new caulking tube extension nozzle embodying the principles and concepts of the present invention and generally designated by the reference numeral 10 will be described.

The caulking tube extension nozzle 10 comprises a nozzle coupling assembly 12 which may be threadably engaged to either a soft plastic caulking nozzle typically provided on conventional caulking tubes or a threaded nozzle receiver typically provided on caulking tubes having detachable nozzles. The nozzle coupling assembly 12 integrally tapers into an extension assembly 14 which is of a length sufficient to allow a distribution of caulking into hard-to-reach or awkwardly positioned areas. To further facilitate such distribution, the extension assembly 14 is comprised of a elongated tube 16 having a flexible section 18 which allows the extension tube assembly to be bent around obstructions while still permitting fluid communication therethrough. The extension assembly 14 continues to define a conical tip 20 which may be trimmed to create an opening through which caulking may be dispensed. The caulking tube extension nozzle 10 may be constructed as either a reusable article or a disposable article which may be simply discarded after use.

In use, the caulking tube extension nozzle 10 may be positioned over the soft plastic caulking nozzle provided with the caulking tube, whereby thread means provided within the nozzle coupling assembly 12 will threadably engage and tap the nozzle. Alternatively, the caulking tube extension nozzle 10 may be engaged to the threaded nozzle receiver provided on caulking tubes having detachable nozzles by allowing the threaded nozzle receiver to threadably engage and tap a further interior surface of the nozzle coupling assembly 12. In either case, the conical tip 20 may then be trimmed to define an appropriately sized and shaped opening through which the caulking may be dispensed, whereby the same may be accomplished through a conventional use of a caulking dispenser or the like.

More specifically, it will be noted that the caulking tube extension nozzle 10 comprises a nozzle coupling assembly 12 defined by a cylindrical member 22 having gripping means in the form of a pair of wings 24 projecting from diametrically opposed exterior surfaces thereof. The wings 24 are operable to provide a gripping means through which a rotation of the nozzle coupling assembly 12 may be accomplished. A tapered member 26 is integrally or otherwise connected to the cylindrical member 22 and serves to connect the extension assembly 14 to the coupling assembly 12.

As best illustrated in FIGS. 3 and 4, the nozzle coupling assembly 12 comprises an unlabeled hollow interior defining a first interior surface 28 having a substantially tapered shape in which thread means in the form of a helical member 30 is disposed. A second interior surface 32 is present within the hollow interior of the nozzle coupling assembly 12 and is of a diameter greater than the largest diameter of the tapered first interior surface 28. The first interior surface 28 and its associated helical member 30 are operably to threadably engage and tap the soft plastic caulking nozzle typically provided on some caulking tubes. Alternatively, the second interior surface 32 may be threadably engaged and tapped by the threaded nozzle receiver typically provided on other styles of caulking tubes. The inclusion of the first and second interior surfaces 28, 32 within the nozzle coupling assembly 12 allows the caulking tube extension nozzle 10 to be used on a wide variety of caulking tube cartridges.

The extension assembly 14 is integrally or otherwise connected to the taper member 26 which forms a part of the coupling assembly 12. The extension assembly 14 is comprised of a substantially hollow, elongated tube 16 which may be of any desired length. The elongated tube 16 includes a flexible section 18 which allows the elongated tube to be bent into any shape while still permitting fluid communication therethrough. As best illustrated in FIG. 3, it can be shown that the flexible section 18 of the elongated tube 16 comprises a plurality of accordion pleats 34 integrally formed therein which permit the tube 16 to bend without collapsing or kinking. The plurality of accordion pleats 34 also permit the flexible section 18 to be slightly elongated, thereby extending a reach of the extension assembly 14 when needed.

The conical tip 20 is integrally or otherwise formed at a distal end of the elongated tube 16 to complete the extension assembly 14. The conical tip 20 tapers into a closed point which may then be trimmed to define an opening of any desired shape through which the caulking may be dispensed from the caulking tube extension nozzle 10.

In use, the caulking tube extension nozzle 10 may be positioned over the soft plastic caulking nozzle provided with the caulking tube, whereby the thread means 30 provided within the first interior surface 28 of the nozzle coupling assembly 12 will threadably engage and tap the nozzle. Alternatively, the caulking tube extension nozzle 10 may be engaged to the threaded nozzle receivers provided on caulking tubes having detachable nozzles by allowing the threaded nozzle receiver to threadably engage and tap the second interior surface 32 of the nozzle coupling assembly 12. In either case, the conical tip 20 may then be trimmed to define an appropriately sized and shaped opening through which the caulking may be dispensed, whereby the same may be accomplished through a conventional use of a caulking dispenser or the like.

Figure 5:
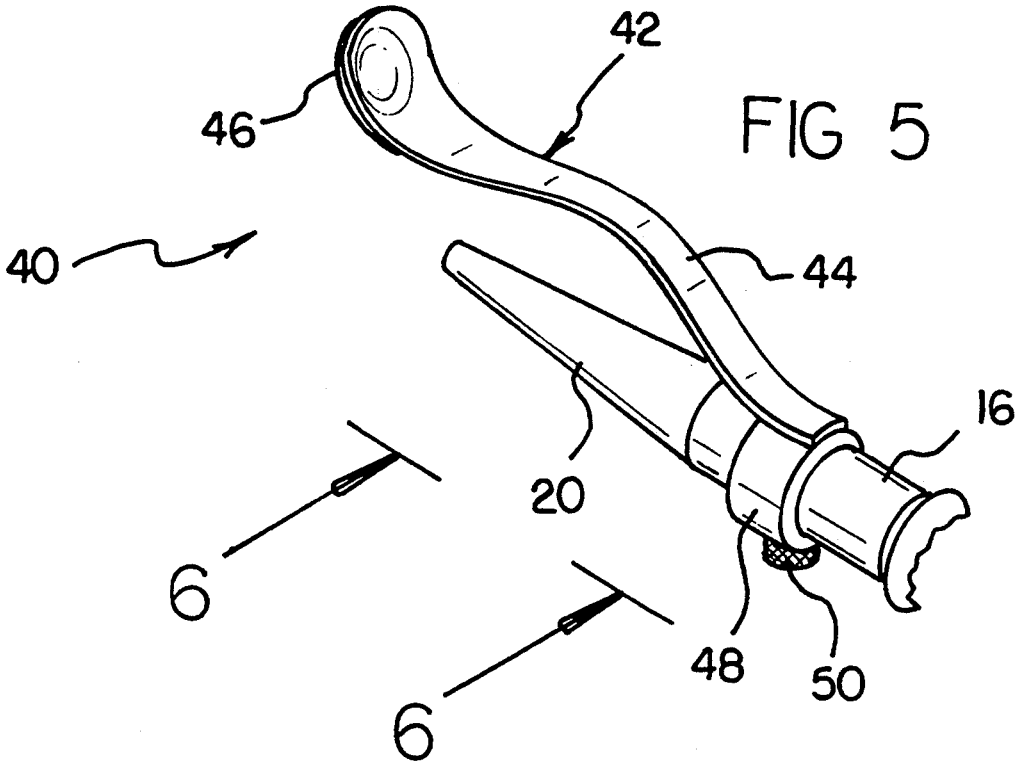
FIG. 5 is a perspective view of a portion of a second embodiment of a caulking tube extension nozzle comprising the present invention.
Figure 6:
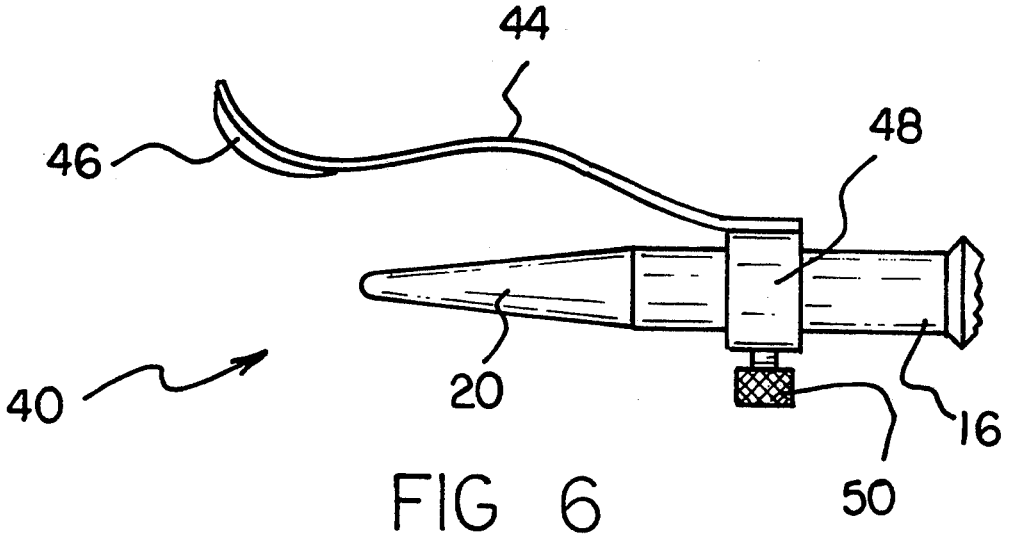
FIG. 6 is a side elevation view of a portion of the second embodiment.

A second embodiment of the present invention as generally designated by the reference numeral 40, which comprises of substantially all the features of the foregoing embodiment 10 and which further comprises a bead forming assembly 42 will now be described. As best shown in FIGS. 5–6, it can be shown that the bead forming assembly 42 comprises a spoon member 44 having a substantial arcuate shape defining a head 46 at a distal end thereof. The spoon member 44 is connected at a proximal end thereof to a collar 48 which is slidably disposed upon a portion of the elongated tube 16 near the conical tip 20. A securing fastener 50 is threadably engaged to an unlabeled aperture passing through the collar 48 and may be operated in a well understood manner to secure a position of the collar 48 with respect to the elongated tube 16. In this manner, the spoon member 44 may be adjusted to any longitudinal or angular position with respect to the elongated tube 16.

The head 46 of the spoon member 44 is substantially semi-spherically shaped and is operable to smooth a bead of caulk dispensed from the caulking tube extension nozzle 10. Although the head 46 is illustrated and described as being semi-spherical, the head may be of any desired shape including flat or angled designs.

Figure 7:
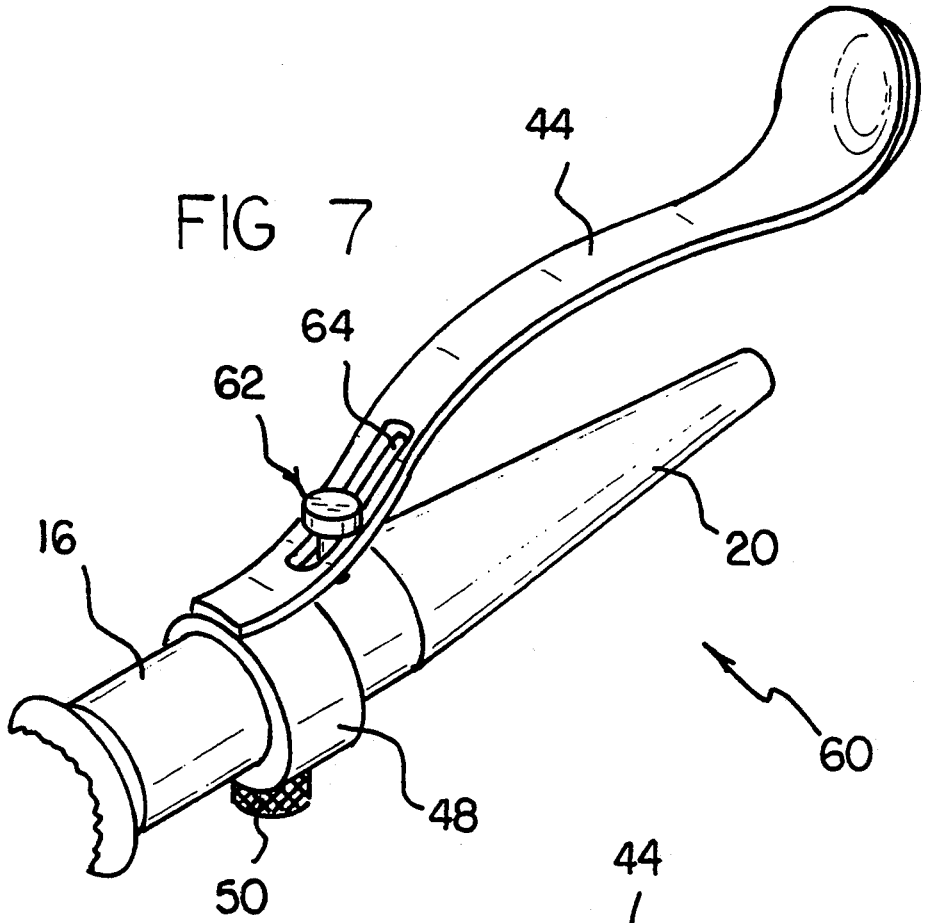
FIG. 7 is a perspective view of a portion of a third embodiment of a caulking tube extension nozzle comprising the present invention.
Figure 8:
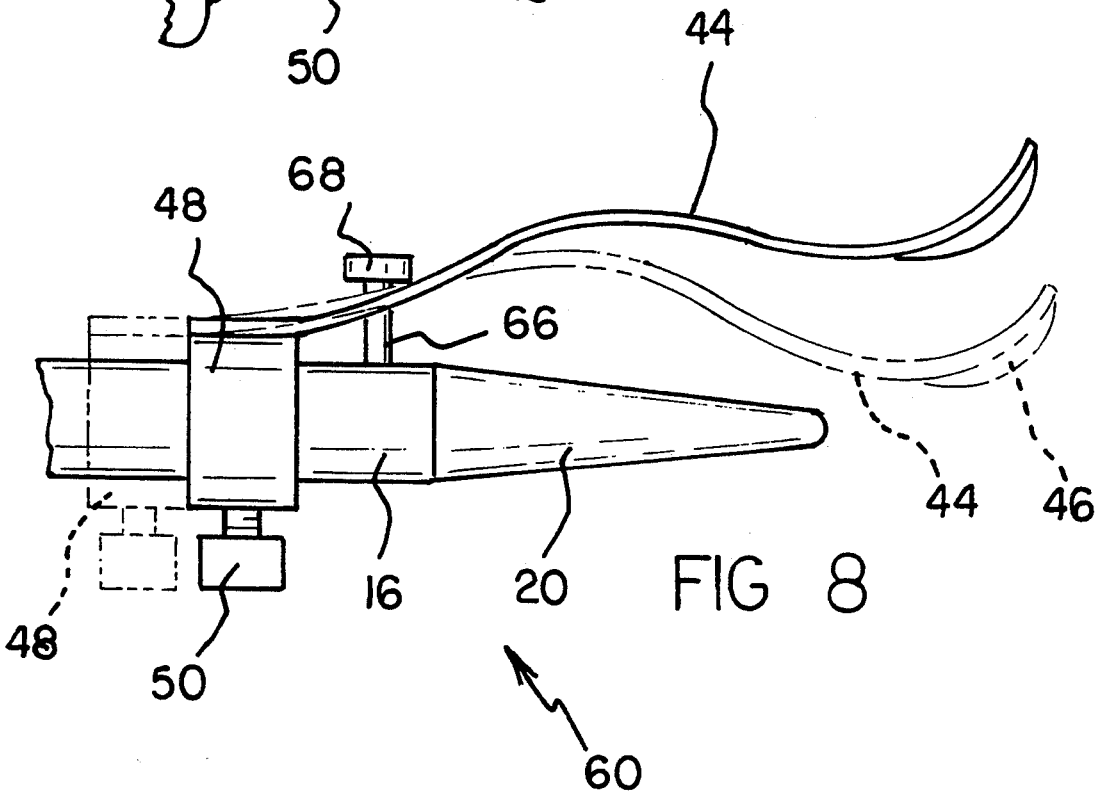
FIG. 8 is a side elevation view of the portion of the third embodiment of the present invention illustrated in FIG. 7.

Comprising all the features and structure of the previous embodiments 10, 40 is a third embodiment which is generally designated by the reference numeral 60 and may be viewed in FIGS. 7–8. It can be shogun that the third embodiment 60 further comprises a pivot assembly 62 which, in addition to the longitudinal adjustments provided by the relative position of the collar 48 with respect to the elongated tube 16, allows the head 46 of the spoon member 44 to be positioned closer to the conical tip 20, as best displayed by the phantom illustration of FIG. 8.

To provide this movement, the pivot assembly 62 comprises an elongated aperture 64 formed in the spoon member 44. An upstanding post 66 is fixedly secured to the elongated tube 16 and projects through the elongated aperture 64 of the spoon member 44. Positioned at a top end of the upstanding post 66 is a stop 68 which is operable to engage the spoon member 44 and, because of the spoon members arcuate shape, bias the spoon member and its associated head 46 toward the conical tip 20. The pivot assembly 62 allows the bead forming assembly 42 to be positioned by a user at a desired distance away from the conical tip 20.

As to further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A caulking tube extension nozzle comprising:

a nozzle coupling means for attaching to a caulking tube, said coupling means comprising a hollow cylindrical member; gripping means coupled to an exterior surface of said cylindrical member for facilitating a rotation of said cylindrical member, said gripping means comprising at least one wing member fixedly secured to said cylindrical member; said cylindrical member having a first interior surface with thread means for engaging a caulking tube nozzle, said thread means comprising a helical member disposed upon said first interior surface; said cylindrical member further having a second interior surface engagable to a caulking tube nozzle receiver, said first interior surface having a first diameter and said second interior surface having a second diameter, with said second diameter is greater than said first diameter;

an elongated tube coupled to said nozzle coupling means in fluid communication with said caulking tube, said elongated tube having a flexible section allowing said tube to bend, said flexible section comprising a plurality of pleats formed in said elongated tube;

a conical tip in fluid communication with said tube, said conical tip being trimable to define an opening through which caulking may be dispensed;

a bead forming means coupled to said elongated tube for shaping a bead of caulking dispensed from said elongated tube, said bead forming means comprising a collar slidably disposed upon said elongated tube; a fastening means for securing a position of said collar along and around said elongated tube; an arcuate spoon member coupled to said collar and extending therefrom past said conical tip; and a head member positioned at a distal end of said spoon member, whereby said head member may contact and shape said caulking dispensed through said conical tip;

and, a pivot means for pivoting said bead forming means towards said conical tip.

2. The caulking tube extension nozzle of claim 1, wherein said pivot means comprises an upstanding post orthogonally coupled to said elongated tube and projecting through said elongated aperture; and a stop coupled to a top end of said upstanding post, whereby a movement of said collar along said elongated tube and towards said coupling means moves said head member towards said conical tip.

* * * * *